US008231514B2

(12) United States Patent
Rimondi et al.

(10) Patent No.: US 8,231,514 B2
(45) Date of Patent: Jul. 31, 2012

(54) FOLDING ASSEMBLY AND METHOD FOR PRODUCING A GABLE PORTION OF A SEALED PACKAGE OF A POURABLE FOOD PRODUCT

(75) Inventors: Fabrizio Rimondi, Castel San Pietro Terme (IT); Massimo Pradelli, Reggio Emilia (IT); Paolo Fontanazzi, Modena (IT); Lars Jeppsson, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 145 days.

(21) Appl. No.: 12/162,564

(22) PCT Filed: Feb. 26, 2007

(86) PCT No.: PCT/EP2007/051817

§ 371 (c)(1),
(2), (4) Date: Jul. 29, 2008

(87) PCT Pub. No.: WO2007/099086

PCT Pub. Date: Sep. 7, 2007

(65) Prior Publication Data

US 2009/0005227 A1 Jan. 1, 2009

(30) Foreign Application Priority Data

Feb. 28, 2006 (EP) ..... 06110477

(51) Int. Cl.
*B31B 1/50* (2006.01)
*B31B 1/28* (2006.01)

(52) U.S. Cl. ..... 493/165; 493/184

(58) Field of Classification Search ..... 493/184, 493/133.2, 247, 165, 175; 53/133.2, 133
See application file for complete search history.

(56) References Cited

U.S. PATENT DOCUMENTS 3,513,755 A * 5/1970 Nestler et al. ..... 493/194

(Continued)

FOREIGN PATENT DOCUMENTS

EP 1 440 010 B1 7/2004

(Continued)

OTHER PUBLICATIONS

Form PCT/ISA/210 (International Search Report) dated Apr. 25, 2007.

(Continued)

*Primary Examiner* — Rinaldi I. Rada
*Assistant Examiner* — John Paradiso
(74) *Attorney, Agent, or Firm* — Buchanan Ingersoll & Rooney PC

(57) ABSTRACT

A folding assembly for producing a gable portion of a sealed package of pourable product, wherein the gable portion has first and second walls sloping with respect to each other and joined at a seal, and a flap connecting lateral edges of the first and second walls. The folding assembly is supplied with packs, each having an axis and, at one end and on opposite sides of the axis, two end portions which are folded to form the gable portion, with the end portions having, respectively, a first and a second portion to be folded, which are joined by a lateral face of the pack. The folding assembly includes a folding mechanism which interacts, on opposite sides of the axis, with the first and second portion of the pack to fold the second portion onto the lateral face, and the first portion onto the second portion to form the flap.

19 Claims, 6 Drawing Sheets

U.S. PATENT DOCUMENTS

| | | | | |
|---|---|---|---|---|
| 3,999,469 | A | 12/1976 | Nilsson | |
| 4,510,732 | A | 4/1985 | Löthman | |
| 5,369,933 | A * | 12/1994 | Waldstadt | 53/375.9 |
| 5,809,743 | A | 9/1998 | Ylonen et al. | |
| 5,867,966 | A * | 2/1999 | Mogard | 53/133.2 |
| 6,357,203 | B1 * | 3/2002 | Cicha et al. | 53/370.6 |
| 6,599,225 | B2 * | 7/2003 | Ammons et al. | 493/183 |
| 7,090,630 | B2 * | 8/2006 | Boldrini et al. | 493/51 |

FOREIGN PATENT DOCUMENTS

| | | | |
|---|---|---|---|
| EP | 1 584 563 | A1 | 10/2005 |
| SU | 574140 | A3 | 9/1977 |

OTHER PUBLICATIONS

Form PCT/ISA/237 (Written Opinion of the International Searching Authority) dated Apr. 25, 2007.

English-language translation of Russian Official Action issued in the corresponding Russian Patent Application No. 2008138575/20.

English-language translation of Russian Official Action issued in the corresponding Russian Patent Application No. 2008138575/20(049690).

* cited by examiner

FOLDING ASSEMBLY AND METHOD FOR PRODUCING A GABLE PORTION OF A SEALED PACKAGE OF A POURABLE FOOD PRODUCT

TECHNICAL FIELD

The present invention relates to a folding assembly and method for producing a gable portion of a sealed package of a pourable food product.

The folding assembly can be integrated in a folding unit of packaging machines for continuously producing sealed packages of pourable food products from a tube of packaging material.

BACKGROUND ART

Many pourable food products, such as beverages, fruit juice, pasteurized or UHT (ultra-high-temperature treated) milk, wine, tomato sauce, etc., are sold in packages made of sterilized packaging material.

One example of this type of package is the gable-top package for liquid or pourable food products, as described in European Patent EP1440010 and in published Patent Application EP1584563, and known by the trade name Tetra Gemina™ Aseptic.

More specifically, the above package comprises a parallelepiped-shaped main portion; and a gable top portion defined by two sloping walls joined along a sealing strip.

More specifically, the walls of the gable portion are trapezoidal in shape, project from the main portion of the package at their respective major bases, and are joined by the sealing strip at their respective minor bases.

The gable portion comprises two lateral flaps folded outside the volume of the package available for the food product.

The flaps each project from a respective oblique side of a first wall, and are folded towards the second wall and superimposed, at the sealing strip, on respective oblique sides of the second wall.

The above package is produced by folding and sealing laminated strip packaging material.

The packaging material has a multilayer structure substantially comprising a base layer for stiffness and strength, which may comprise a layer of fibrous material, e.g. paper, or mineral-filled polypropylene material; and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminium foil or ethyl vinyl alcohol (EVOH) film, which is superimposed on a layer of heat-seal plastic material, and is in turn covered with another layer of heat-seal plastic material forming the inner face of the package eventually contacting the food product.

As is known, packages of this sort are produced on fully automatic packaging machines, on which a continuous tube is formed from the web-fed packaging material. More specifically, the web of packaging material is unwound off a reel and fed through an aseptic chamber on the packaging machine, where it is sterilized, e.g. by applying a sterilizing agent, such as hydrogen peroxide, which is subsequently evaporated by heating and/or by subjecting the packaging material to radiation of appropriate wavelength and intensity; and the web so sterilized is maintained in a closed, sterile environment, is folded into a cylinder, and is sealed longitudinally to form a continuous tube in known manner.

The tube of packaging material, actually forming an extension of the aseptic chamber, is fed continuously in a vertical direction, is filled with the sterilized or sterile-processed food product, and is fed through a forming unit for producing the individual packages. That is, inside the forming unit, the tube is sealed along a number of equally spaced cross sections to form a continuous strip of pillow packs connected to one another by respective transverse sealing strips, i.e. extending perpendicular to the travelling direction of the tube. And the pillow packs are separated by cutting the relative transverse sealing strips, and are then folded further to form respective finished gable-top packages.

DISCLOSURE OF INVENTION

It is an object of the present invention to provide a folding assembly for producing the top gable portion of the above packages quickly, cheaply, and reliably, while at the same time achieving optimum finish of the gable portion itself.

According to the present invention, there is provided a folding assembly for producing a gable portion of a sealed package of a pourable food product; said gable portion comprising a first and a second wall sloping with respect to each other and joined at a seal, and at least one flap connecting corresponding lateral edges of said first and second wall; said folding assembly being supplied with packs having an axis, and which, at one end and on opposite sides of said axis, comprise two end portions which are folded to form said gable portion of said package; said end portions having, respectively, a first and a second portion to be folded, which are joined by a lateral face of said pack interposed between said end portions; and said folding assembly being characterized by comprising folding means which interact, on opposite sides of said axis, with said first and second portion of said pack to fold said second portion onto said lateral face, and said first portion onto said second portion to form said flap.

The present invention also relates to a folding method for producing a gable portion of a sealed package of a pourable food product; said gable portion comprising a first and a second wall sloping with respect to each other and joined at a seal, and at least one flap connecting corresponding lateral edges of said first and second wall; said method comprising the step of:

supplying a folding assembly with at least one sealed pack having an axis, and which, at one end and on opposite sides of said axis, comprises two end portions having, respectively, at least a first and a second portion to be folded; said first and said second portion being joined by a lateral face of said pack interposed between said end portions; and said method being characterized by comprising the steps of:

folding said second portion onto said lateral face; and folding said first portion onto said second portion to form said flap.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 1:
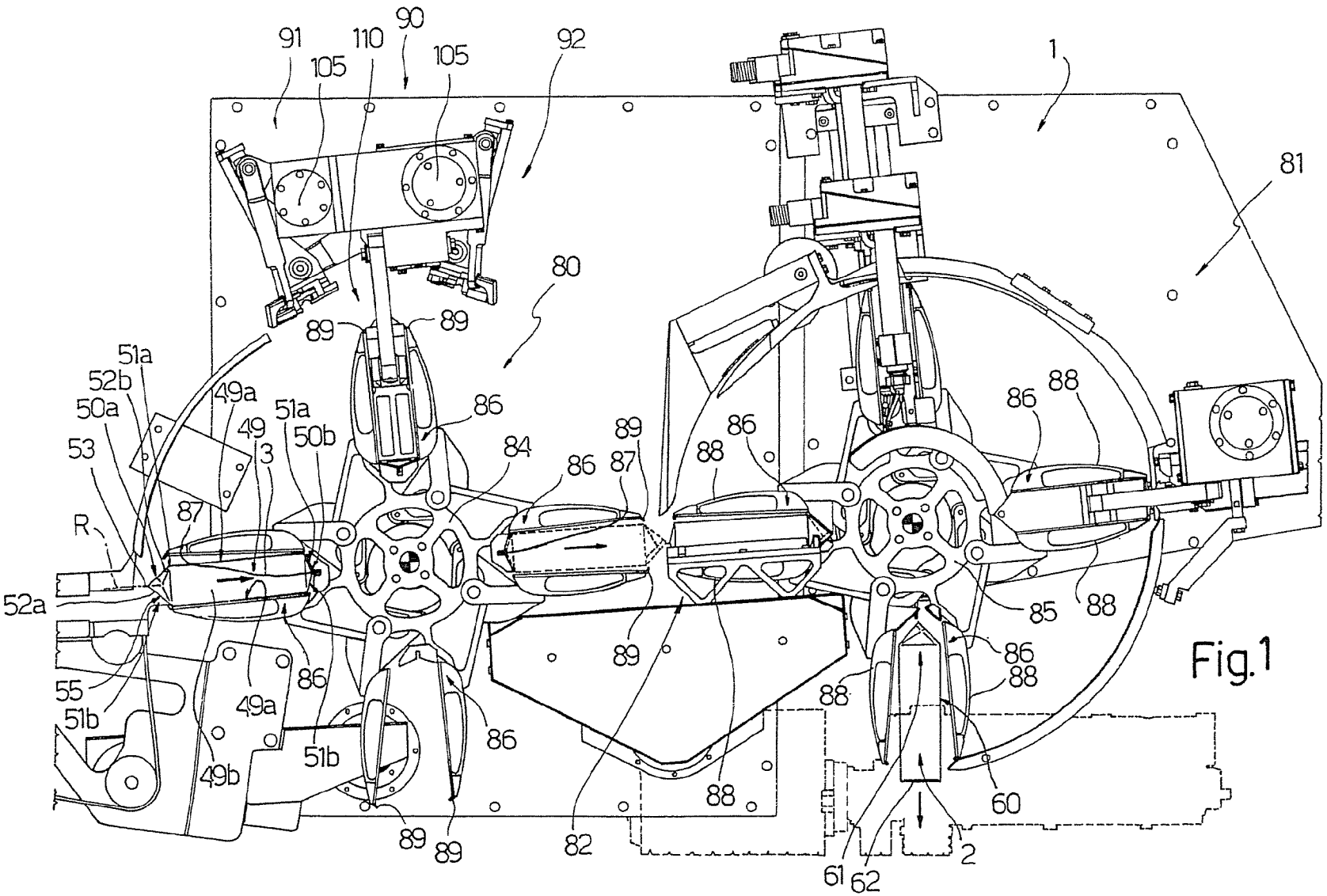
FIG. 1 shows a side view of a folding unit comprising a folding assembly in accordance with the present invention.

Number 1 in FIG. 1 indicates as a whole a folding unit of a packaging machine (not shown) for continuously producing sealed gable-top packages 2 (FIG. 7) of a pourable food product, such as pasteurized or UHT milk, fruit juice, wine, etc., from a known tube (not shown) of packaging material.

The tube is formed in known manner upstream from unit 1 by longitudinally folding and sealing a web of heat-seal sheet material.

The packaging material has a multilayer structure substantially comprising a base layer for stiffness and strength, which may comprise a layer of fibrous material, e.g. paper, or mineral-filled polypropylene material; and a number of layers of heat-seal plastic material, e.g. polyethylene film, covering both sides of the base layer.

In the case of aseptic packages 2 for long-storage products, such as UHT milk, the packaging material also comprises a layer of gas- and light-barrier material, e.g. aluminium foil or ethyl vinyl alcohol (EVOH) film, which is superimposed on a layer of heat-seal plastic material, and is in turn covered with another layer of heat-seal plastic material forming the inner face of package 2 eventually contacting the food product.

Figure 8:
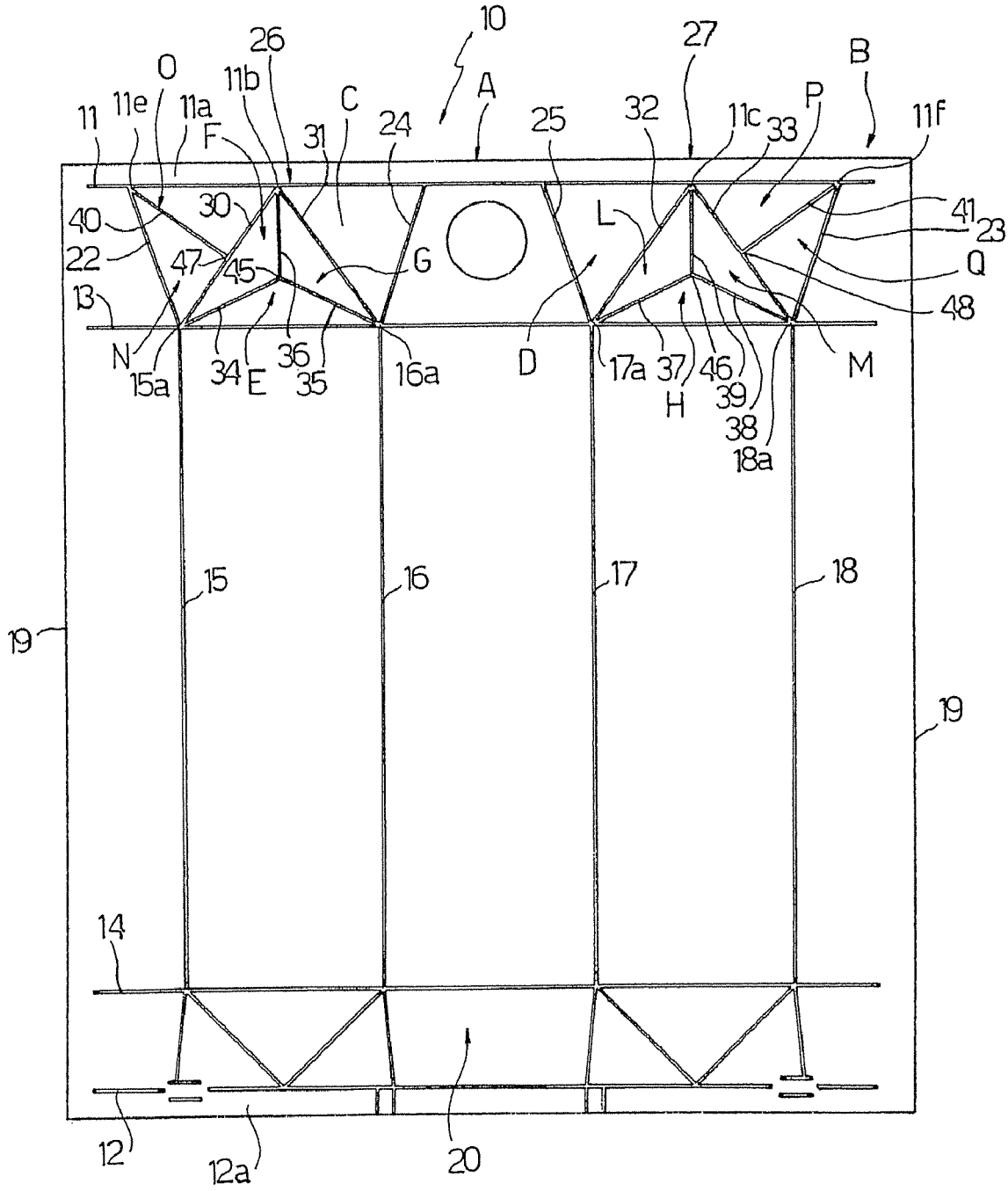
FIG. 8 shows a web of packaging material having a number of fold lines (crease pattern).

With particular reference to FIG. 8, the web of packaging material comprises a crease pattern 10, i.e. a number of fold lines, along which the material is folded, during the folding operation, to form a pillow pack 3 first, and then package 2.

Crease pattern 10 comprises four transverse fold lines 11, 12, 13, 14. Lines 11, 12 are located close to the ends of the packaging material, and define respective top and bottom sealing areas 11*a*, 12*a*.

Crease pattern 10 comprises, in known manner, four longitudinal fold lines 15, 16, 17, 18 extending between transverse fold lines 13, 14.

Crease pattern 10 also comprises a number of further fold lines 20 located in the area between line 14 and sealing area 12*a*, and which form lateral flaps (not shown) which are subsequently folded to form a bottom wall 62 of package 2.

The pattern of fold lines 20 is known and therefore not described in detail.

Lines 15, 18 are located close to lateral edges 19 of the packaging material, and lines 16, 17 are interposed between lines 15 and 18.

Crease pattern 10 also comprises a number of additional fold lines in the area between lines 11 and 13.

The additional lines comprise two fold lines 22, 23 extending obliquely between lines 11, 13 and converging from line 11 to line 13; and two fold lines 24, 25 extending between lines 11, 13 and converging from line 13 to line 11.

Lines 22, 23, 24, 25 originate at respective intersection points 15*a*, 18*a*, 16*a*, 17*a* of respective lines 15, 18, 16, 17 and line 13, and, in the embodiment shown, slope slightly in the longitudinal direction.

Lines 22 and 24, the portion of line 13 between points 15*a* and 16*a*, and the portion of line 11 between the intersection point of lines 11 and 24 and an intersection point 11*e* of lines 22 and 11, define an area 26. Similarly, lines 23 and 25, the portion of line 13 between points 17*a* and 18*a*, and the portion of line 11 between an intersection point 11*f* of lines 11 and 23 and the intersection point of lines 11 and 25, define an area 27.

Lines 24 and 25, the portion of line 11 between the intersection points of lines 24, 25 and line 11, and the portion of line 13 between points 16*a* and 17*a*, define a panel A interposed between areas 26 and 27 and in the form of an isosceles trapezium with the oblique sides converging from line 13 to line 11.

Lines 22 and 23, the portion of line 11 extending between points 11*e* and 11*f*, on the opposite side to panel A, and the portion of line 13 extending between points 15*a* and 18*a*, on the opposite side to panel A, define a panel B interposed between areas 26 and 27 and in the form of an isosceles trapezium with the oblique sides converging from line 13 to line 11.

Crease pattern 10 comprises, in area 26, two fold lines 30, 31 originating respectively at points 15*a*, 16*a* and joined at a point 11*b* along line 11 to define an isosceles triangle with the portion of line 13 extending between points 15*a* and 16*a*. Similarly, crease pattern 10 comprises, in area 27, a further two fold lines 32, 33 originating respectively at points 17*a* and 18*a* and joined at a point 11*c* along line 11 to define an isosceles triangle with the portion of line 13 extending between points 17*a* and 18*a*.

Lines 31, 24 and the portion of line 11 extending between point 11*b* and the intersection point of lines 24 and 11, define the outer boundaries of a triangular panel C adjacent to panel A. And, similarly, lines 32, 25 and the portion of line 11 extending between point 11*c* and the intersection point of lines 25 and 11, define the outer boundaries of a triangular panel D adjacent to panel A and on the opposite side to panel C.

Crease pattern 10 comprises three lines 34, 35, 36 in area 26, and three lines 37, 38, 39 in area 27; lines 34, 35, 36 extend respectively from points 15*a*, 16*a*, 11*b* to a point 45 within the isosceles triangle in area 26; and lines 37, 38, 39 extend respectively from points 17*a*, 18*a*, 11*c* to a point 46 within the isosceles triangle in area 27.

Lines 34, 35 extend symmetrically on opposite sides of an extension of line 36; and lines 37, 38 extend symmetrically on opposite sides of an extension of line 39.

There are therefore defined, in area 26, a panel E in the form of an isosceles triangle and bounded by lines 34, 35 and the portion of line 13 extending between points 15*a*, 16*a*; a triangular panel F bounded by lines 30, 34, 36; and a triangular panel G bounded by lines 31, 35, 36.

Similarly, there are defined, in area 27, a panel H in the form of an isosceles triangle and bounded by lines 37, 38 and the portion of line 13 extending between points 17*a*, 18*a*; a triangular panel L, bounded by lines 32, 37, 39; and a triangular panel M bounded by lines 33, 39, 38.

Crease pattern 10 also comprises, in area 26, a line 40 extending between intersection point 11*e* of lines 11 and 22, and a point 47 located substantially at the mid-point of line 30. And, in the same way, crease pattern 10 comprises, in area 27, a line 41 extending between the intersection point 11*f* of lines 11 and 23, and a point 48 located substantially at the mid-point of line 33.

There are therefore defined, in area 26, a triangular panel N bounded by lines 22, 40 and the portion of line 30 extending between points 15*a* and 47; and a triangular panel O bounded by line 40, the portion of line 11 extending between points 11*e* and 11*b*, and the portion of line 30 extending between points 11*b* and 47.

Similarly, there are defined, in area 27, a triangular panel Q bounded by lines 23, 41 and the portion of line 33 extending between points 18*a* and 48; and a triangular panel P bounded by line 41, the portion of line 33 extending between points 11*c* and 48, and the portion of line 11 extending between points 11*c* and 11*f*.

Once formed, the tube of packaging material is filled with the food product for packaging, and is sealed and cut along equally spaced cross sections to form a number of pillow packs 3 (shown in FIG. 1).

Figure 6:
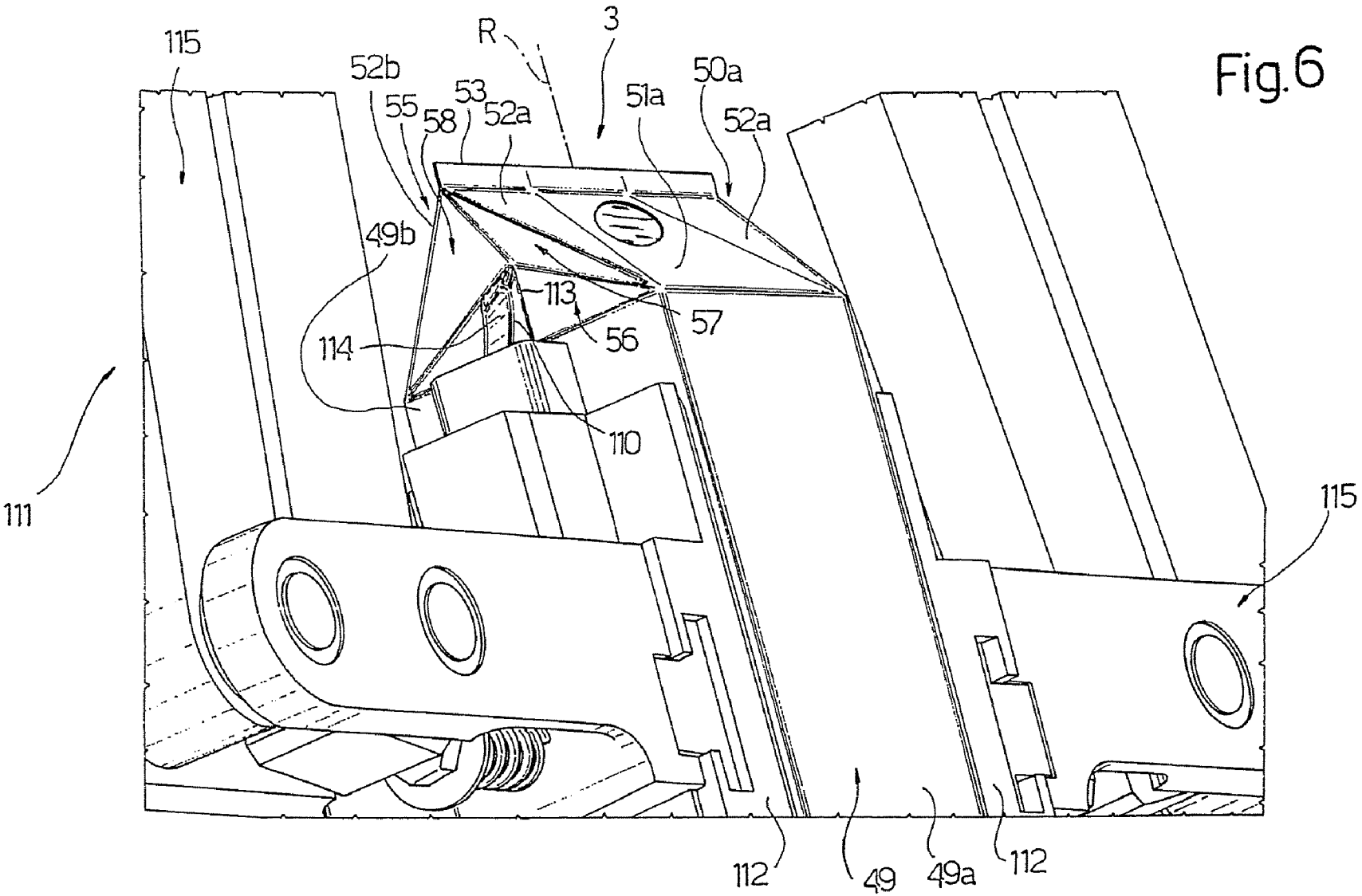
FIG. 6 shows a further component part of the FIG. 2-5 folding assembly, as it interacts with a pillow pack during formation of the gable portion.

FIG. 6 shows a partial view of pack 3 at the start of forming a gable portion 61 (FIG. 7) of corresponding package 2.

More specifically, packs 3 extend along an axis R, and each comprise in known manner a parallelepiped-shaped main portion 49, and opposite end portions 50*a*, 50*b* (only one shown in FIG. 6) tapering from portion 49 towards respective transverse sealing strips 53 of pack 3.

Portion 49 corresponds to the area of the web extending between lines 13 and 14. More specifically, said area is folded along lines 15, 16, 17 and 18 to form two parallel walls 49*a* (only one shown in FIG. 6), and two parallel walls 49*b* (only one shown in FIG. 6) perpendicular to walls 49*a*.

Walls 49*a* correspond to the areas between lines 16 and 17 and between lines 15 and 18; and walls 49*b* correspond to the areas between lines 15 and 16 and between lines 17 and 18.

Portions 50*a*, 50*b* correspond to the areas of the web extending between lines 11 and 13 and between lines 12 and 14 respectively; and strips 53 correspond to areas 11*a*, 12*a* of the web of packaging material.

Each portion 50*a*, 50*b* is defined by a respective pair of walls 51*a*, 51*b*, which are substantially in the form of an isosceles trapezium, slope slightly towards each other with respect to a plane perpendicular to the longitudinal axis R of pack 3, and have major edges defined by respective end edges of opposite walls 49*a*, and minor edges joined to each other by relative strip 53.

More specifically, walls 51*a*, 51*b* of portion 50*a* correspond respectively to panels A, B of the web of packaging material.

Each pack 3 comprises, on wall 51*a*, two substantially triangular portions 52*a* projecting laterally on opposite sides of wall 51*a* and defined by end portions of wall 51*a*.

Similarly, each pack 3 comprises, on wall 51*b* of portion 50*a*, two substantially triangular portions 52*b* projecting laterally on opposite sides of wall 51*b* and defined by end portions of wall 51*b*.

Portions 52*a* of wall 51*a* correspond respectively to panels C and D, and portions 52*b* of wall 51*b* correspond respectively to panels N, O and Q, P of the web of packaging material.

Each portion 52*a* of wall 51*a* is connected to a corresponding portion 52*b* of wall 51*b* by a respective lateral face 55. Each face 55 comprises a respective surface 56 in the form of an isosceles triangle and extending upwards from respective wall 49*b*; and a respective pair of triangular surfaces 57, 58 having a first side in common. Each surface 57, 58 also has a second side in common with surface 56, and a third side in common with a relative portion 52*a*, 52*b*.

Faces 55 correspond respectively to the isosceles triangle defined by points 11*b*, 16*a*, 15*a* of the packaging material, and to the isosceles triangle defined by points 17*a*, 18*a*, 11*c*.

Surfaces 56 correspond respectively to panels E, H of the web of packaging material; surfaces 57 and 58 of a first face 55 correspond respectively to panels G, F of the web of packaging material; and surfaces 57, 58 of a second face 55 correspond respectively to panels L, M.

Packs 3 are then sent to unit 1, where they are folded mechanically to form respective packages 2.

Figure 7:
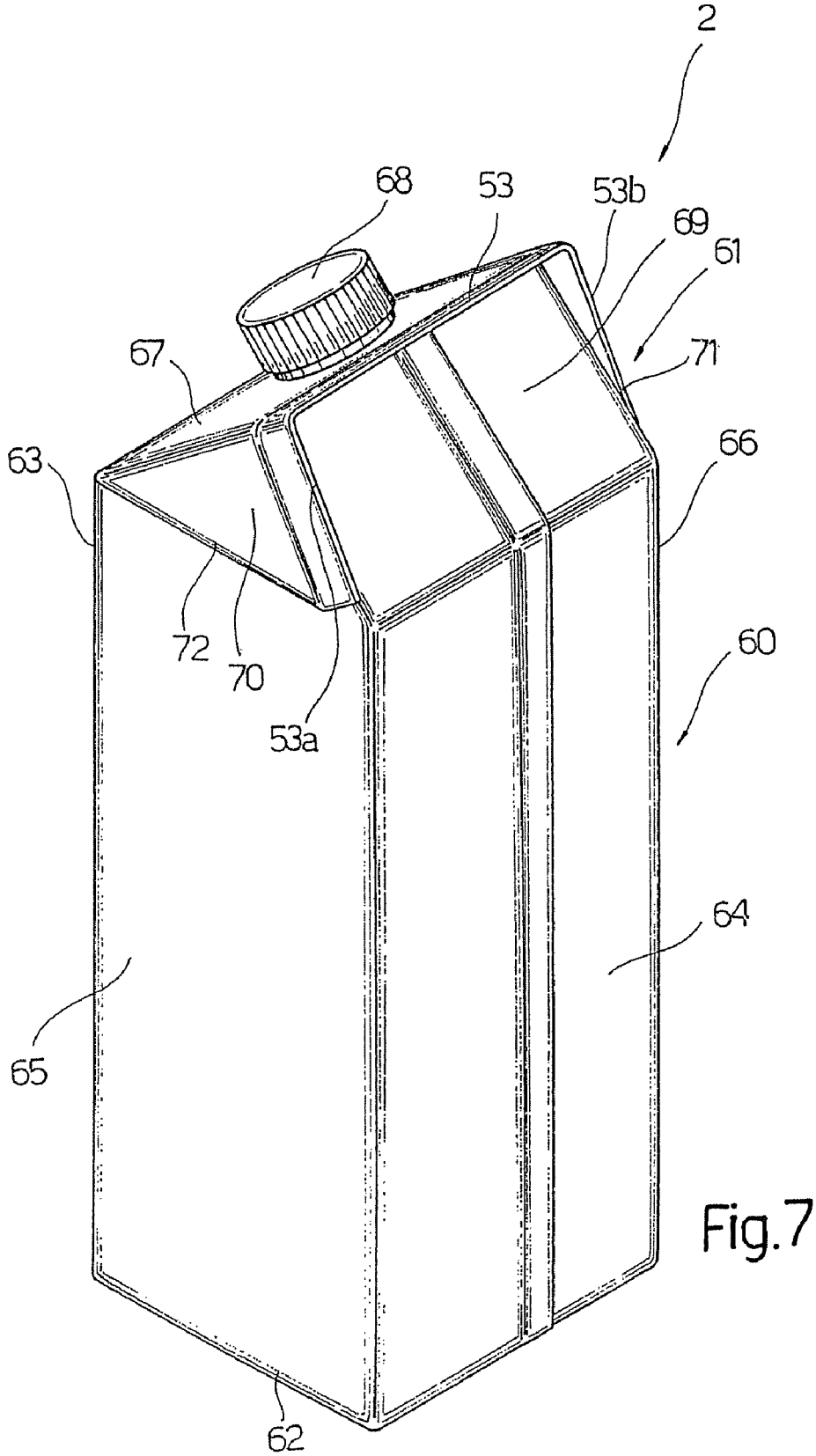
FIG. 7 shows a package produced by the FIG. 1 unit.

With particular reference to FIG. 7, packages 2 each substantially comprise a parallelepiped-shaped main portion 60 corresponding to portion 49 of pack 3; and gable portion 61, which defines the top of portion 60 and is formed by folding portion 50*a* of pack 3 on unit 1, as described in detail below.

Package 2 also comprises bottom wall 62 defining the bottom of portion 60 and formed by folding portion 50*b* of pack 3 on unit 1 in a manner not described, by not being essential to a clear understanding of the present invention; two parallel walls 63, 64; and two parallel walls 65, 66 extending perpendicularly between walls 63, 64 of package 2.

More specifically, walls 63, 64, 65, 66 extend perpendicularly to the plane of wall 62.

Walls 63 and 64 correspond respectively to the areas of the web extending between lines 16 and 17 and between lines 15 and 18; and walls 65 and 66 correspond respectively to the areas of the web extending between lines 15 and 16 and between lines 17 and 18.

Portion 61 comprises a wall 67 having an opening device 68; and a wall 69 joined to wall 68 at top sealing strip 53.

More specifically, walls 67 and 69 are each in the form of an isosceles trapezium, slope with respect to walls 63, 64, 65 and 66, converge towards top strip 53, extend at their respective major bases from respective walls 63 and 64, and are joined at their respective minor bases adjacent to top strip 53.

Walls 67 and 69 correspond respectively to panels A and B of the web of packaging material.

Portion 61 also comprises two lateral flaps 70, 71 folded outside the volume of package 2 available for the food product, and extending along extensions of, and obliquely with respect to, respective walls 65, 66.

More specifically, each flap 70, 71 is triangular and defined by a respective oblique side of wall 67, by a relative end 53*a*, 53*b* of strip 53 folded onto a relative oblique side of wall 69, and by a relative edge 72 parallel, when folded, to relative wall 65, 66.

More specifically, flaps 70, 71 correspond respectively to panels D, C of the web of packaging material, and are folded to superimpose lines 32, 31 on respective lines 23, 22.

With particular reference to FIG. 1, unit 1 comprises a station 80 supplied with pillow packs 3 and for folding portion 50*a* to form portion 61 of each package 2; a station 81 supplied with packs 3 complete with respective portions 61, and for forming wall 62 of package 2 corresponding to each said pack 3; and a transfer carriage 82 for transferring pack 3, complete with portion 61, from station 80 to station 81.

In a manner not shown, station 81 also heats portion 61 and wall 62, seals flaps 70, 71 to the oblique sides of wall 69, and seals wall 62 to portion 60 to form the complete package 2.

Carriage 82 moves back and forth between stations 80 and 81, and performs a forward movement to transfer pack 3, complete with portion 61, from station 80 to station 81, and a return movement in which it is empty.

Station 81 is not described in detail, by not being essential to a clear understanding of the present invention.

More specifically, each station 80, 81 comprises a respective hub 84, 85 powered by a respective motor not shown; and a respective member of conveying devices 86—four in the example shown—angularly integral with relative hub 84, 85.

Station 80 also comprises a folding assembly 90 which interacts with portion 50*a* of each pack 3 to form portion 61 of a corresponding package 2.

More specifically, devices 86 are fixed, equally spaced angularly, to relative hub 84, 85, and each comprise a groove 87 facing relative hub 84, 85 and which engages strip 53 of relative portion 50*b*, 50*a*; and two paddles 88 which cooperate respectively with walls 49*a* of pack 3 corresponding to walls 63, 64 of package 2.

Each device 86 at station 80 receives a pack 3 in a first angular position, in which pack 3 is inclined slightly with respect to a horizontal plane; feeds it clockwise along a roughly ninety-degree arc to a second angular position, in which assembly 90 folds portion 50*a* to form portion 61; and then feeds pack 3, complete with portion 61, along a further roughly ninety-degree clockwise arc to a third angular position, where pack 3, complete with portion 61, is picked up by carriage 82 and transferred to station 81.

Each paddle 88 comprises, on its outer end, an edge 89 bent towards the other paddle 88 of the same device 86 to prevent pack 3 from spinning off as hubs 84, 85 rotate.

Along the arc between the first and third angular position, devices 86 are set to a closed configuration in which paddles 88 cooperate with walls 49*a* of pack 3.

In the first and third angular position, on the other hand, devices 86 are set to an open configuration in which paddles 88 are parted to supply station 80 with pack 3 with relative portions 50*a*, 50*b* to be folded, and, respectively, to supply carriage 82 with pack 3 complete with portion 61.

Assembly 90 advantageously interacts, on opposite sides of axis R of each pack 3, with portions 52*a*, 52*b* of pack 3, to fold each portion 52*b* onto relative surface 56, and each portion 52*a* onto relative portion 52*b* to form a relative flap 70, 71 of package 2.

With reference to FIGS. 2 to 5, assembly 90 comprises two tools 91, 92 for folding each portion 52*b* onto relative surface 56, and each portion 52*a* onto relative portion 52*b* respectively. More specifically, each portion 52*b* is folded onto relative surface 56 after first being folded onto relative line 40, 41.

Tools 91, 92 are hinged to respective output members of respective motors 105 about respective axes T parallel to the axes of rotation of hubs 84, 85, and are hinged to each other about a common axis S parallel to axes T.

More specifically, tool 91 comprises a supporting surface 100 and two folding surfaces 101, which cooperate respectively with wall 51*b* to control the volume of portion 61 being formed, and with portions 52*b* to fold them onto relative surfaces 56.

Surfaces 100 and 101 are moved integrally with one another in an approach movement into contact with wall 51*b* and portions 52*b* respectively, and are moved with respect to one another in a folding movement in which surfaces 101 fold portions 52*b* onto relative surfaces 56.

More specifically, tool 91 comprises a frame 95 fitted, on one side, with projecting surface 100, and connected operatively, on the opposite side, to surfaces 101; two first levers 93 hinged to frame 95 and to the output member of relative motor 105; and a second lever 94 hinged to tool 92 and to frame 95.

Frame 95 comprises a first member 96 fitted on one end, and on the opposite side to axis S, with projecting surface 100; and a second member 97 which slides with respect to member 96 and is hinged to levers 93 about an axis U parallel to axis S.

Levers 93 are hinged, at one end, to the output member of motor 105 about axis T, and are hinged, at the opposite end, to frame 95 about axis U.

Lever 94 is hinged, at one end, to tool 92 about axis S, and is hinged, at the opposite end, to frame 95 about an axis V parallel to axis S.

Tool 91 also comprises two third levers 99, each of which is hinged, at one end, to relative lever 93 about axis U, and is connected operatively and movably, at the opposite end, to surface 100 and to a respective surface 101 by means of a respective connecting rod 102.

More specifically, each connecting rod 102 is L-shaped, is hinged at opposite ends to surface 100 and to a plate 107 integral with relative surface 101, and comprises an intermediate portion, between surface 100 and relative plate 107, which is housed inside a circular through seat formed on the end of relative lever 99 opposite axis U.

Members 96 and 97 are connected elastically to each other by a spring 98, which is compressed during the folding movement of surfaces 101, and expands when surface 100 withdraws from wall 51*b*.

Tool 92 is similar to tool 91, and is only described insofar as it differs from tool 91, using the same reference numbers for identical or corresponding parts of tools 91, 92.

Tool 92 differs from tool 91 by relative surface 100 cooperating with wall 51*a* at the end of the relative approach movement.

Surfaces 101 are the same triangular shape as portions 52*a*, and fold portions 52*a* onto portions 52*b*, once surface 100 cooperates with wall 51*a*.

Tool 92 also comprises two levers 94 spaced apart and which are hinged to lever 94 of tool 91 about axis S.

Folding assembly 90 also comprises two pressure members 110 (FIGS. 1 and 6), each of which exerts pressure on a relative surface 56, when forming relative flap 70, 71, to facilitate folding of portions 52*a*, 52*b*.

More specifically, pressure members 110 are fitted to an actuating assembly 111 connected operatively to motor 105 of tool 91 in known manner not shown.

Assembly 111 (shown only partly in FIG. 6) comprises two plates 112, which cooperate with respective walls 49*b* of pack 3, and from which respective pressure members 110 project; and two lever mechanisms 115 connected to motor 105 of tool 91 by a cam mechanism not shown.

Motor 105 and lever mechanisms 115 are so connected that, when surface 100 of tool 91 cooperates with wall 51*b*, members 110 cooperate with relative surfaces 56, and, when surface 100 of tool 91 is detached from wall 51*b*, members 110 are detached from relative surfaces 56.

More specifically, pressure members 110 are preferably made of deformable plastic material, and are tooth-shaped. More specifically, each pressure member 110 comprises a flat surface 113 which cooperates with relative surface 56; and a surface 114, opposite surface 113, which tapers from relative plate 112 and cooperates with relative surfaces 57, 58 once portions 52*a*, 52*b* are folded.

Operation of assembly 90 will now be described with reference to one pack 3, and as of a start instant in which pack 3 is supplied to station 80 of unit 1.

More specifically, inside a relative device 86 in the first angular position, pack 3, positioned with axis R sloping slightly with respect to a horizontal plane, is housed with strip 53 inside groove 87, and with walls 49*a* gripped by paddles 88.

Rotation of hub 84 moves device 86 into the second angular position, in which pack 3 is adjacent to assembly 90.

As hub 84 rotates, edges 89 prevent pack 3 from being spun off.

In the second angular position of device 86, motor 105 of tool 91, by means of the cam mechanism and lever mechanisms 115, moves each plate 112 onto relative wall 49*b* of pack 3, and surface 113 of each pressure member 110 onto relative surface 56.

Next, motors 105 operate tools 91, 92 to perform the respective approach movements of respective surfaces 100.

More specifically, surface 100 of tool 91 contacts wall 51*b* of pack 3 before surface 100 of tool 92 contacts wall 51*a* of pack 3.

Next, motor 105 of tool 91 is operated further to perform the respective folding movements of surfaces 101 of tool 91, and so fold portions 52*b* onto relative surfaces 56.

More specifically, portions 52*b* are folded with respect to wall 51*b* at respective lines 22, 23, and are folded over along respective lines 40, 41 to superimpose respective panels N, Q on respective portions of respective panels E, H.

At this point, motor 105 of tool 92 is operated to perform the respective folding movements of surfaces 101 of tool 92, and so fold portions 52*a* onto respective portions 52*b*.

More specifically, portions 52*a* are folded with respect to wall 51*a* at respective lines 24, 25.

By the end of the folding movements, panels D, C are superimposed respectively on panels P, O, which in turn are superimposed respectively on panels Q, N, which are superimposed respectively on panels H, E.

Once folded, panels D, C define respective flaps 70, 71, and have respective lines 32, 31 superimposed on respective lines 23, 22.

Figure 3:
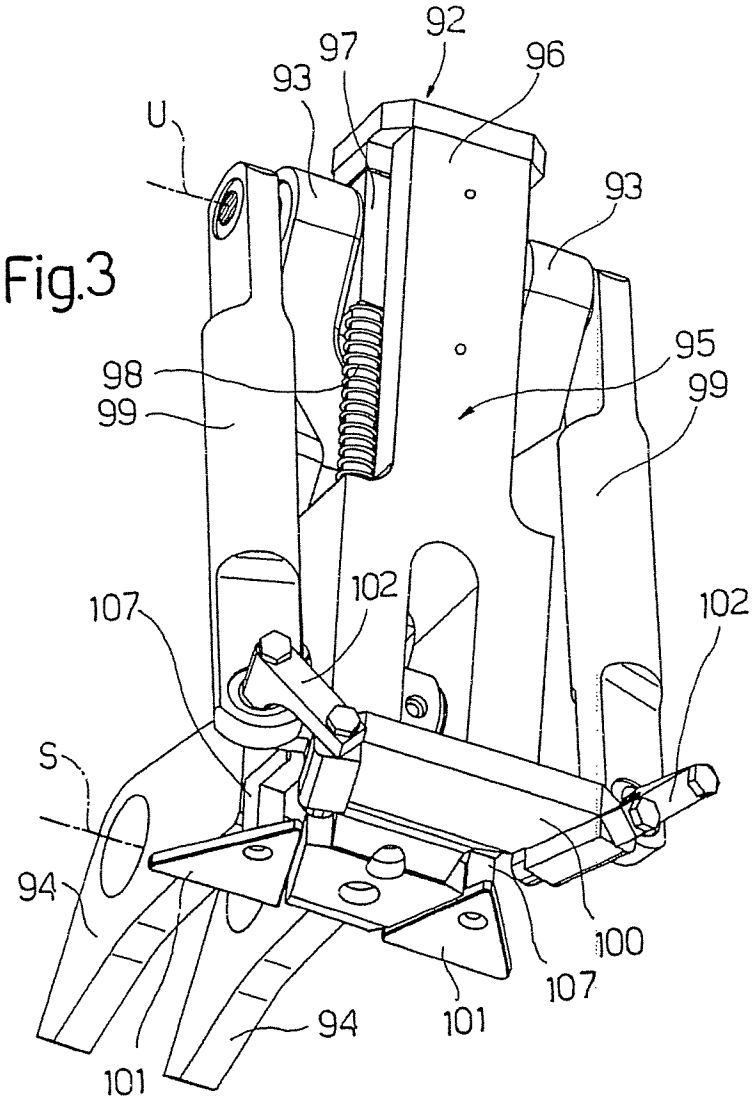
FIGS. 2 and 3 show views in perspective of various component parts of the FIG. 1 folding assembly.
Figure 2:
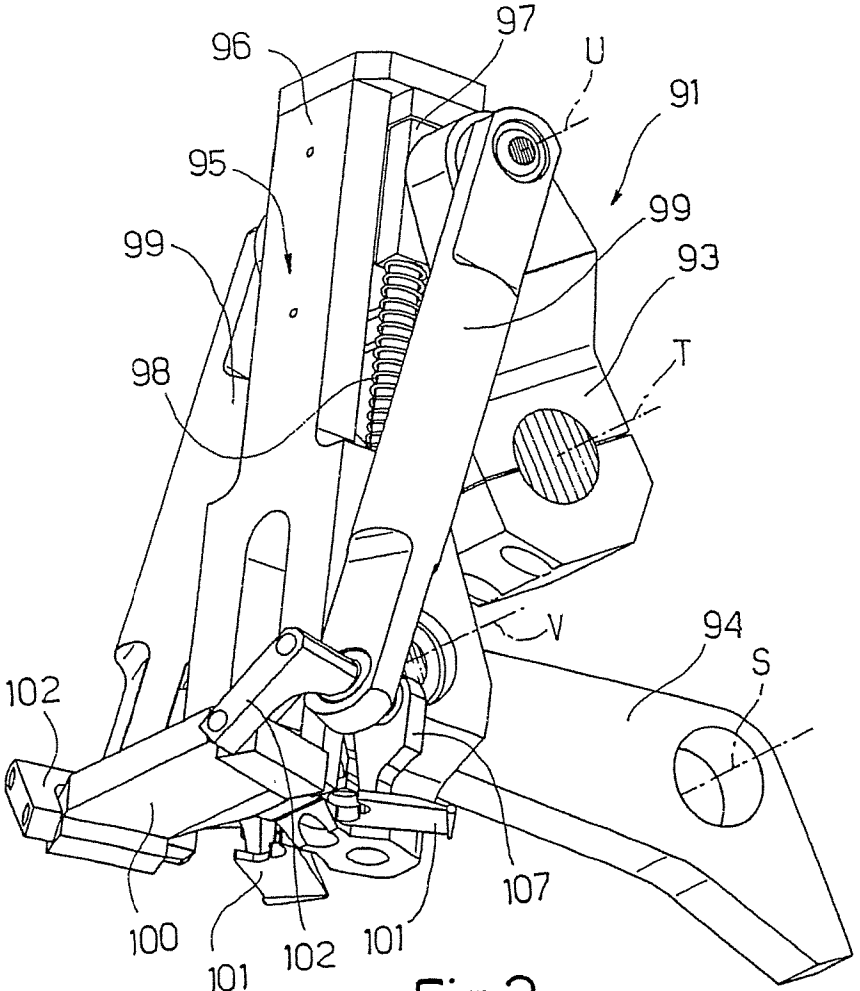
Figure 5:
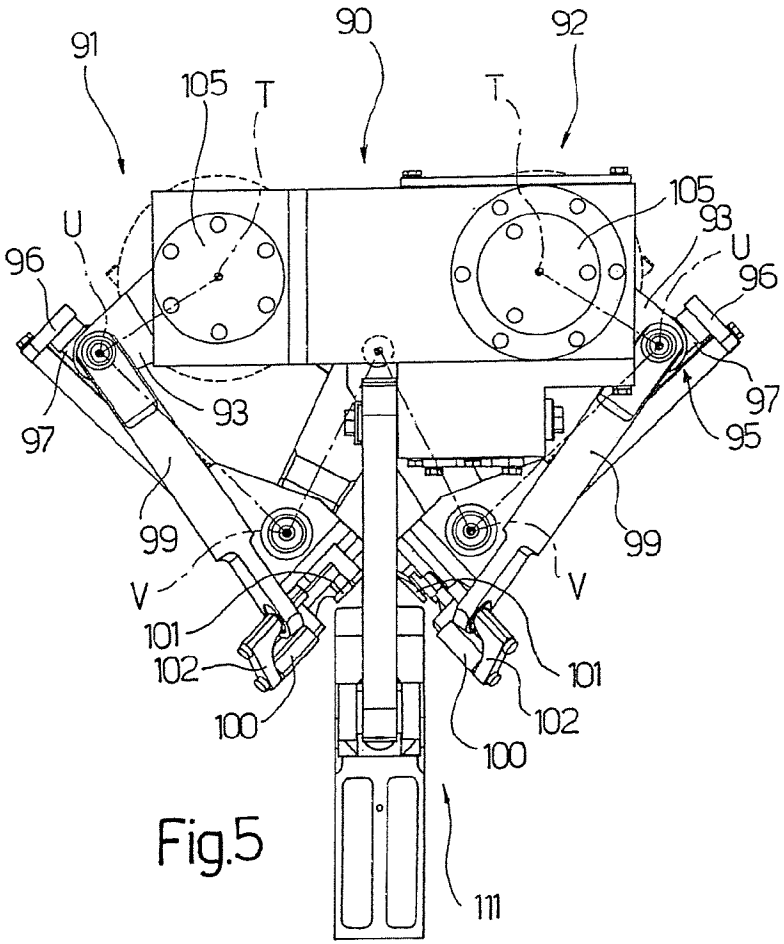
FIGS. 4 and 5 show a further component part of the FIG. 1 folding assembly in two different operating configurations.
Figure 4:
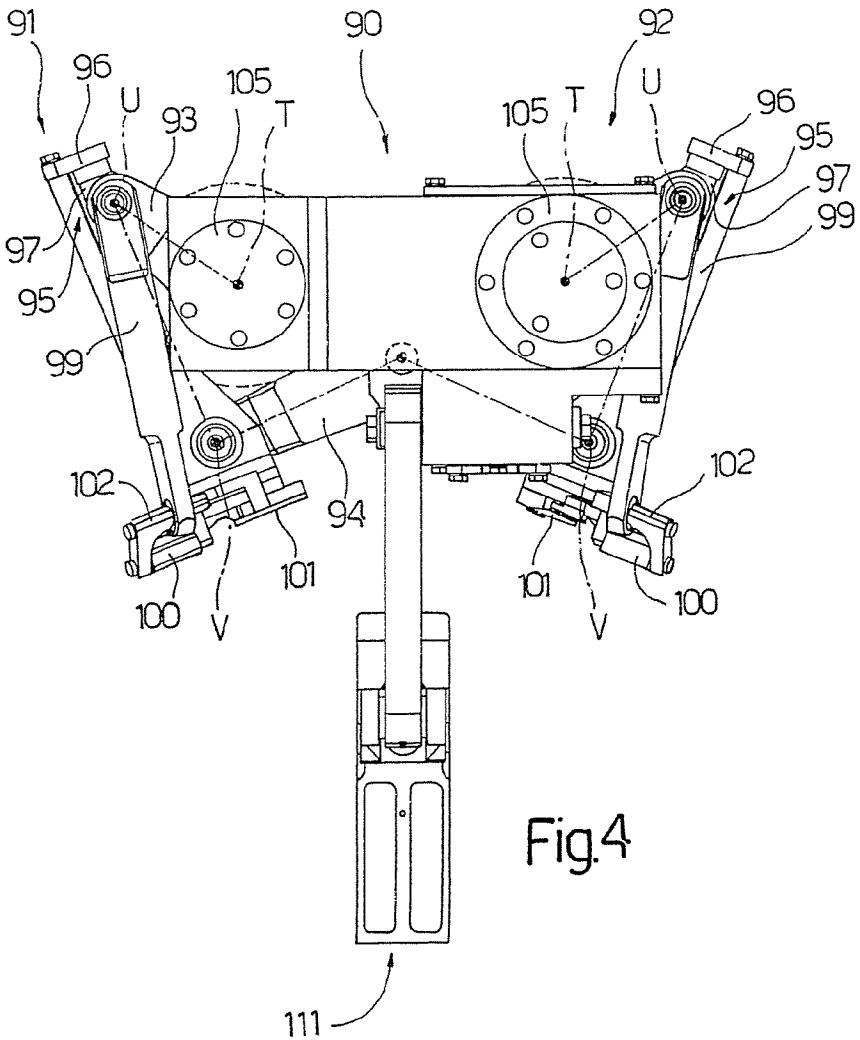

More specifically, the approach movements commence from a start position in which each member 97 rests against relative member 96 (FIGS. 2 and 3).

During the approach movements, motors 105, by means of levers 93, rotate surfaces 100, 101 of tools 91, 92, integrally with one another, about axes U until surfaces 100 come to rest against walls 51*a*, 51*b* of pack 3. During the approach movements, members 96, 97 of frames 95 also move integrally with one another.

Once the approach movements are completed, motors 105, by means of levers 93, rotate levers 99 and members 97 of tools 91, 92 further with respect to relative axes U, T, thus compressing springs 98 of tools 91, 92.

Rotation of levers 99 rotates connecting rods 102 of tools 91, 92 with respect to relative surfaces 100, and so, by means of plates 107, rotates the pairs of surfaces 101 with respect to relative surfaces 100.

By the end of the folding movements, ends 53*a*, 53*b* are detached slightly from the oblique sides of wall 69, and faces 55 are detached slightly from surfaces 56 to permit heating and sealing at station 81.

Once the folding movements are completed, motors 105 are operated in reverse to first withdraw members 110 from surfaces 56, then surfaces 101 from flaps 70, 71, and finally surfaces 100 from walls 67, 69.

In the course of the above withdrawal movements, the previously compressed springs 98 expand to restore relative members 97 to the position resting against relative members 96.

At this point, pack 3, complete with portion 61, is moved by hub 84, by means of device 86, a further ninety degrees clockwise into the third angular position, where it is picked up by carriage 82 and transferred to station 81.

At station 81, in known manner not described, by not being essential to a clear understanding of the present invention, wall 62 is formed; ends 53*a*, 53*b* are first heated and then sealed to the oblique sides of wall 69; and faces 55 are first heated and then sealed to wall 69.

The advantages of assembly 90 and the method according to the present invention will be clear from the foregoing description.

In particular, assembly 90 provides for fast formation of portion 61, by operating simultaneously on opposite sides of pack 3.

Moreover, formation of portion 61 by assembly 90 is highly repeatable, on account of members 110 being controlled by motor 105 of tool 91 by means of the cam mechanism.

Finally, assembly 90 provides for a high-quality surface finish of portion 61 by forming portion 61 by successively folding panels of the web of packaging material along relative fold lines. As opposed to being deformed, the panels are therefore simply folded along the fold lines, thus preventing any impairment in the finish of walls 67, 69 and flaps 70, 71.

Clearly, changes may be made to assembly 90 and the method as described herein without, however, departing from the protective scope defined in the accompanying Claims.

The invention claimed is:

1. A folding assembly for producing a gable portion of a sealed package of a pourable food product, the sealed package having a top end associated with dispensing the food product from the package, and a bottom end, said gable portion comprising a first and a second wall sloping with respect to each other and joined at a seal, and a flap on two opposing lateral sides of the gable portion and connecting corresponding lateral edges of said first and second wall; said folding assembly being supplied with packs having an axis and a top end corresponding to the top end of the sealed package, and which, at the top end and on opposite sides of said axis, comprise two end portions which are folded to form said gable portion of said package; said end portions having, respectively, at least a first and a second portion to be folded at the top end of the pack, which are joined by a lateral face of said pack interposed between said end portions; and said folding assembly comprising:

folding means which interact, on opposite sides of said axis, with the top end of the pack, including said first and second portion of said pack, to fold said second portion onto said lateral face, and said first portion on top of said second portion to cover said second portion against said lateral face and form each flap on the opposing lateral sides at the top end of the pack.

2. A folding assembly as claimed in claim 1, wherein said folding means comprise a first and a second folding surface which cooperate respectively with said first portion to fold it onto said second portion, and with said second portion to fold it onto said lateral face; and a first and a second supporting surface which, during the folding of said first and second portion, cooperate respectively with said end portion having said first portion, and with said end portion having said second portion; said first folding surface and said first supporting surface being moved integrally with each other in a relative first approach movement towards said pack and in which said first supporting surface is brought into contact with the end portion having said first portion, and being moved with respect to each other in a relative second folding movement in which said first folding surface folds said first portion onto said second portion; and said second folding surface and said second supporting surface being moved integrally with each other in a relative first approach movement towards said pack and in which said second supporting surface is brought into contact with the end portion having said second portion, and being moved with respect to each other in a relative second folding movement in which said second folding surface folds said second portion onto said lateral face.

3. A folding assembly as claimed in claim 2, wherein said first and said second supporting surface are connected functionally, by respective first members, to respective drive means by which they are driven during the relative approach movements; and wherein said first and said second folding surface are connected functionally, by respective second members movable with respect to respective said first members, to said respective drive means by which they are driven, integrally with the respective said first and said second supporting surface, during the relative said approach movements;

and wherein said first and said second folding surface are hinged respectively to said first and said second supporting surface so as to move, under control of the respective drive means with respect to the respective said first and said second supporting surface, when the respective said first and said second supporting surface respectively contact the end portion having said first portion, and the end portion having said second portion.

4. A folding assembly as claimed in claim 3, wherein said first folding surface is hinged to said first supporting surface by a first connecting rod operated by said drive means; and wherein said second folding surface is hinged to said second supporting surface by a second connecting rod operated by said drive means.

5. A folding assembly as claimed in claim 3, wherein each said first member is connected to the relative said second member by elastic means for moving said second member with respect to the relative said first member during a relative return movement, following the relative said folding movement, of the relative said folding surface and the relative said supporting surface.

6. A folding assembly as claimed in claim 2, wherein said second folding surface for folding said second portion is triangular.

7. A folding assembly as claimed in claim 1, comprising at least one pressure member which cooperates with a relative said lateral face of said pack during the folding of said first and said second portion.

8. A folding assembly as claimed in claim 7, wherein said pressure member is operated to cooperate with the relative lateral face when at least one of said first and said second supporting surface cooperates with the relative end portion, and to be detached from said lateral face when said first and said second supporting surface are detached from the relative end portions.

9. A folding assembly as claimed in claim 8, wherein said pressure member and said drive means are connected functionally to associate the movement of said pressure member with the movement of at least one of said first and said second supporting surface.

10. A folding assembly as claimed in claim 8, wherein said pressure member is made of plastic material.

11. A folding method for producing a gable portion of a sealed package of a pourable food product, the sealed package having a top end associated with dispensing the food product from the package, and a bottom end, said gable portion comprising a first and a second wall sloping with respect to each other and joined at a seal, and at least one flap connecting corresponding lateral edges of said first and second wall; said method comprising:

supplying a folding assembly with at least one sealed pack having an axis and a top end corresponding to the top end of the sealed package, and which, at the top end and on opposite sides of said axis, comprises two end portions having, respectively, at least a first and a second portion at the top end of the pack to be folded; said first and said second portion being joined by a lateral face of said pack interposed between said end portions;

folding said second portion onto said lateral face; and folding said first portion onto said second portion to form said gable portion and said flap at the top end of the pack.

12. A method as claimed in claim 11, wherein the folding of said second portion comprises folding said second portion along a respective fold line so as to cooperate, on opposite sides, with said lateral face and said first portion.

13. A method as claimed in claim 11, wherein upon the folding of said second portion and the folding of said first portion, a pressure member cooperates with said lateral face to facilitate folding of said second portion onto said lateral face.

14. A method as claimed in claim 11, wherein folding of the second portion onto said lateral face is completed before folding of said first portion onto said second portion is completed.

15. A folding assembly for producing a gable portion of a sealed package of a pourable food product, the sealed package having a top end associated with dispensing the food product from the package, and a bottom end, the gable portion comprising first and second walls sloping with respect to each other and joined at a seal, and a flap on two opposing lateral sides of the gable portion and connecting corresponding lateral edges of the first and second walls, the folding assembly being supplied with packs having an axis and a top end corresponding to the top end of the sealed package, and which, at the top end and on opposite sides of the axis, comprise two end portions which are folded to form the gable portion of the package, the end portions having, respectively, at least a first and a second portion to be folded at the top end of the pack, which are joined by a lateral face of the pack interposed between the end portions, the folding assembly comprising:

a rotatable hub;

a plurality of spaced apart devices which each receive a pack, such that the top end of the pack is received before an opposing bottom end of the pack, the devices projecting radially outwardly from the hub and being rotatable together with the hub;

each device comprising two paddles which respectively cooperate with walls of the top end of the pack;

first and second folding surfaces adapted to interact on opposite sides of the axis of the pack with the first portion at the top of the pack and the second portion at the top of the pack respectively;

the first folding surface being adapted to cooperate with the first portion of the pack to fold the first portion of the pack on top of the second portion of the pack to cover the second portion against the lateral face, and the second folding surface being adapted to cooperate with the second portion of the pack to fold the second portion of the pack onto the lateral face to form each flap on the opposing lateral sides at the top end of the pack.

16. A folding assembly as claimed in claim 15, comprising a first supporting surface which cooperates with the end portion having the first portion during the folding of the first portion, and a second supporting surface which cooperates with the end portion having the second portion during the folding of the second portion.

17. A folding assembly as claimed in claim 15, wherein the first folding surface is hinged to the first supporting surface by a first connecting rod, and the second folding surface is hinged to the second supporting surface by a second connecting rod.

18. A folding assembly as claimed in claim 17, wherein the first and second connecting rods are connected to, and operated by, a motor.

19. A folding assembly as claimed in claim 15, wherein the second folding surface for folding the second portion is triangular.

* * * * *